US006326836B1

(12) United States Patent
Kipnis

(10) Patent No.: US 6,326,836 B1
(45) **Date of Patent: *Dec. 4, 2001**

(54) ISOLATED REFERENCE BIAS GENERATOR WITH REDUCED ERROR DUE TO PARASITICS

(75) Inventor: Issy Kipnis, Berkeley, CA (US)

(73) Assignee: Agilent Technologies, Inc., Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/408,737

(22) Filed: Sep. 29, 1999

(51) Int. Cl.[7] ..... G05F 3/02
(52) U.S. Cl. ..... 327/538; 323/315
(58) Field of Search ..... 327/538, 540, 327/543; 323/312, 315

(56) References Cited

U.S. PATENT DOCUMENTS 4,507,573 * 3/1985 Nagano ..... 327/538
4,857,864 * 8/1989 Tanaka et al. ..... 323/315
5,675,243 * 10/1997 Kamata ..... 323/313
5,808,508 * 9/1998 Castellucci et al. ..... 327/538
5,825,236 * 10/1998 Seevinck et al. ..... 327/538
5,942,888 * 8/1999 Tan ..... 323/315
5,982,227 * 11/1999 Kim et al. ..... 327/543
6,087,819 * 7/2000 Kuroda ..... 323/315

* cited by examiner

*Primary Examiner*—Terry D. Cunningham

(57) ABSTRACT

A bias circuit with an input current having a first reference node, the input current being gain divided to form a current smaller than the input current by a magnitude of the gain. The gain divided current being transferred through an intermediate current mirror with optional gain and to provide an output current. The output may have a second reference node that is different in voltage to the reference node of the input current, and multiplies the gain divided current by a gain so that the output current has a value equal to or greater than, but proportional to, the input current whereby an impedance in the output reference node is not reflected back.

6 Claims, 2 Drawing Sheets

ISOLATED REFERENCE BIAS GENERATOR WITH REDUCED ERROR DUE TO PARASITICS

FIELD OF THE INVENTION

The invention relates to a bias generating apparatus, and particularly to current mirroring, and more particularly to current mirroring not having a common reference node.

BACKGROUND OF THE INVENTION

In the current mirror shown in FIG. 1 100 transistor Q1 103 accepts input current Iin and is connected to transistor Q2 105 whereby the transistor output current Iout is related in magnitude and direction to Iin by the transconductance of the transistors. This is due to the common voltage from base to emitter (VBE) of the transistors Q1 and Q2 as connected. When used with transistors, and especially in a circuit using bipolar transistors, the relationship between the input current to Q1 103 and output current received by Q2 105 may be precisely controlled.

In the prior art, both transistors in a current mirror as shown in FIG. 2 have a common emitter connection referred to as the reference node, which in the case of bipolar transistors is commonly the emitter nodes or through resistors in the emitter nodes of the transistors. The VBE of the input transistor with respect to the reference node controls the VBE of the output transistor with respect to the reference node.

It is often desirable that the reference node of the output transistor be connected to some other point than the reference node of the input transistor. This can be a requirement, for example, for an operational amplifier, where mirroring is used extensively, but the output may be referenced to a different voltage than the input reference; that is, there is some degree of isolation between input and output.

In an embodiment of the prior art shown in FIG. 2 200, transistor 203, an NPN bipolar transistor in this embodiment, accepts an input current Iin and sets a VBE reference for transistor 207. Optional transistor 205 prevents excessive loading of the base connections of 205 and 207, but is often not included. The output from transistor 207 is received by transistors 209 and 211, wherein transistor 211 is optional, as discussed before. In like manner, transistor 213 provides an output current to transistors 215 and 217, and the final output current Iout is supplied by transistor 219. Note that transistors 209, 211, and 213 are PNP transistors, since alternating transistor polarity types between stages, where transistors 203, 205, transistors 207, 209, 211, and 213, and transistors 215, 217, and 219 are all considered stages, simplifies interstage connections. The addition of the stages needed to avoid a common reference creates a problem in transistor matching, since errors in matching may occur in any stage, and are multiplied by subsequent stages. This can be a problem with respect to emitters, especially with respect to the emitters of PNP current mirrors such as transistors 209 and 213 in the current mirror composed of transistors 209, 211 and 213. PNP emitters generally both have a higher impedance and have more impedance across a contact, for example, from a PNP emitter to a connection such as a wire. It is very important where designing for matched impedance is a problem, that differences in emitter impedance, and especially resistance, be minimized.

What is needed is a bias circuit for precise control of the DC current with different reference nodes which is tolerant of emitter impedance effects in the current mirrors, and more particularly to allow an unbalanced impedance in the emitter circuit of the output transistor.

SUMMARY OF THE INVENTION

In a multistage bias current generating circuit having an output and an input referenced to different voltages, the output is referenced only by a control current, and does not depend on transconductance. In this way, an impedance in the reference path of the output does not unbalance the relationship between input and output. Additionally, the current though intermediate stages is reduced to reduce the effects of parasitic impedances. Reducing the current also reduces parasitic effects due to unwanted impedances in the contacts and material, since these effects are essentially current times impedance. The reduced current is then increased back by substantially the same amount as the reduction to provide an output current with a desired relationship with the input. Either an input current or an input voltage will be provided to the circuit.

Other objects, features and advantages of the present invention will become apparent from the following detailed description when taken in conjunction with the accompanying drawings.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
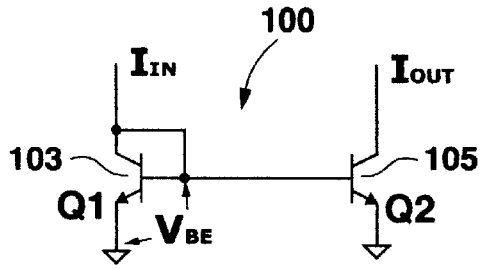
Fig. 1 PRIOR ART
FIG. 1 is a bias current generating circuit of the prior art, also called a current mirror.
Figure 2:
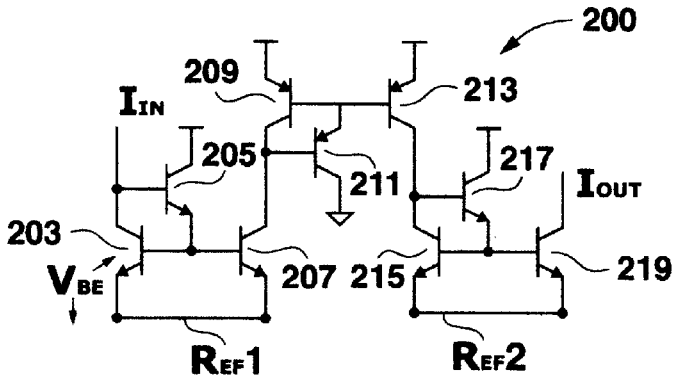
Fig. 2 PRIOR ART
FIG. 2 is a bias current generating circuit of the prior art further having different references for the input and the output, but which does not allow an unbalanced impedance in the emitter of the output transistor
Figure 3:
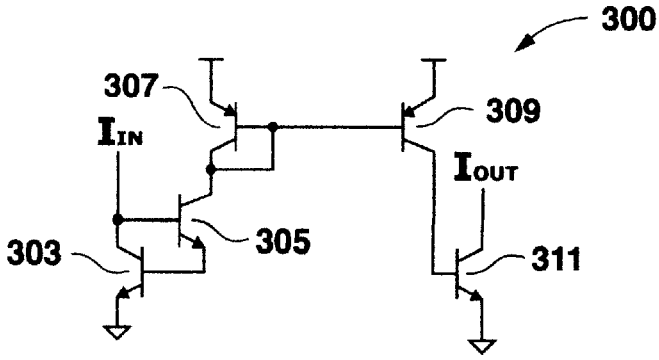
FIG. 3 is an embodiment of the circuit of FIG. 2 further including the current reduction and increasing elements of the invention.

An embodiment of the invention shown in FIG. 3 300 solves the problem disclosed in the prior art. Transistor 303 and 305 cooperate to receive an input current Iin. However, the output current from transistor 305 results from the emitter current of transistor 305, which is the base current of transistor 303. Since the beta of an NPN transistor is normally on the order of 100 or more, the output current from 305 to PNP transistor 307 is divided by beta, and is a very small current relative to the input current. This has several advantages. Even large differences in the parasitic resistance in the emitters of the following transistors, such as 307 and 309, become relatively unimportant, since the effect of an unbalanced impedance would appear as a voltage, but the reduction of current reduces that voltage because voltage is equal to current times impedance. The reduced current is then provided to the base of an output transistor 311 and beta multiplied back up to an output current lout with the value of the input current. Even more important, the matching between the input transistor 303 and the output transistor 311 is by currents only, therefore an impedance in the emitter of 311 substantially does not create an imbalance between the input and output. For the transistors 307 and 309, which in this embodiment are PNP bipolar transistors, the reduced current substantially reduces the effects of parasitic emitter resistance. The effect in the prior art of a difference in emitter impedance was beta times higher, substantially, or typically more than 100 times.

The prior art taught away from this method, due to a fear that the leakage in a circuit would "swamp", or overcome, the benefits of the lower current and also due to a perception that matching between transistors in a current source was by transconductance only. In general, the prior literature and usage was directed toward maintaining substantially the same, or at least similar, currents throughout the bias circuit and toward the use of two transistors having a common reference for an output. In the present art leakage and other undesirable effects are being reduced and beta is becoming more controllable. Meanwhile, adding an impedance in the reference in a unique output is becoming more important. In fact, the benefits of reducing the voltage effects due to unbalanced emitter impedances will often to outweigh the loss of control due to parasitic effects such as leakage, as this loss was perceived by the prior art.

If the resistance in the emitters of the transistors in a bias circuit can be matched, that is, if the voltage across the resistance in the emitter circuit of one transistor can be made equal to the voltage across the resistance in the emitter of another transistor sharing common base and reference connections, the voltages can be used to reduce differences in the currents from the currents desired. This beneficial effect results whether the resistances are parasitic or planned. As will be seen in FIG. 4, resistances are sometimes drawn connected to the emitters of the transistors to emphasize that parasitics or discrete resistances are being used for greater matching accuracy, also called "trimming". Such resistances do not directly affect the circuit functions, so need not be discussed separately.

Figure 4:
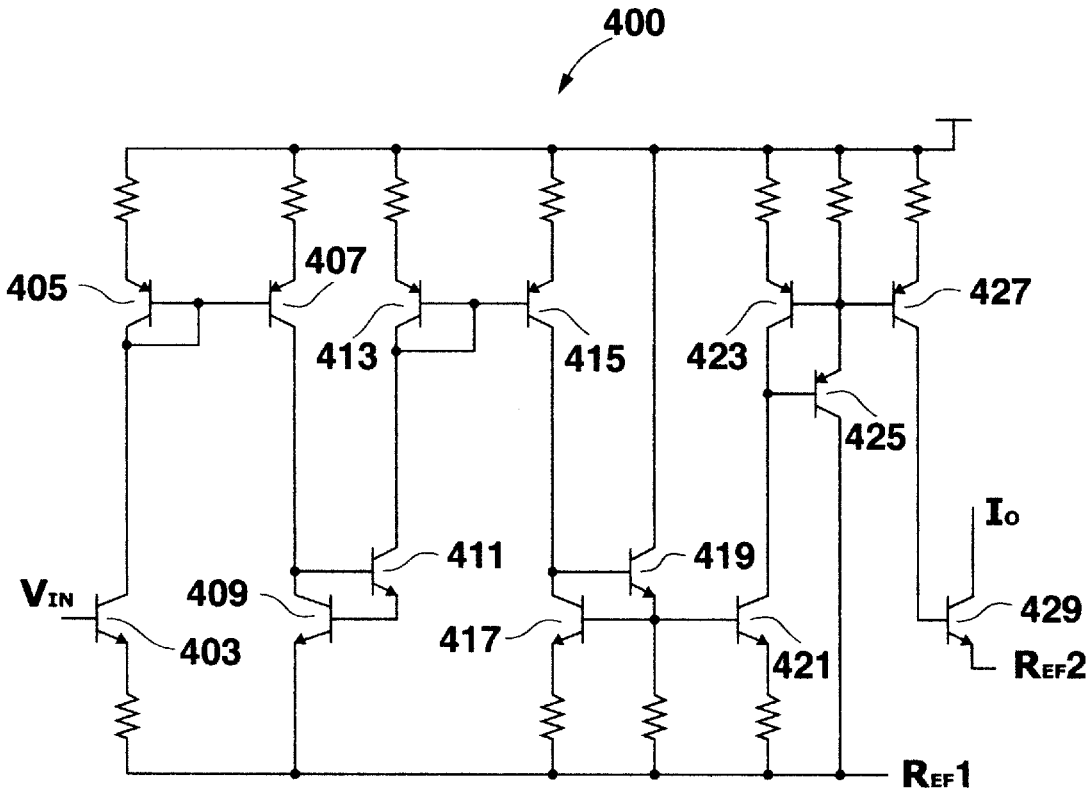
FIG. 4 is an embodiment of a complete circuit with the features of FIG. 3 included therein.

In the embodiment of the invention shown in FIG. 4 400, a working circuit is shown as implemented in a present apparatus. From voltage Vin, transistor 403 provides a voltage to current conversion, since this embodiment is a voltage to current bias circuit.

The current from transistor 403 is received by transistor 405, and related transistor 407 provides an output current which is in proportion to the voltage sensed by transistor 403. Transistor 405 in cooperation with transistor 407 supplies a current to transistors 409 and 411, which cooperate to provide a voltage that is just sufficient to induce transistor 409 to receive that current. Transistor 411 provides a current to transistor 413 reduced by the beta of transistor 409 to a much smaller value than the input current provided to transistor 409. Transistors 413 and 415 operate at a much reduced current level, and any differences in the emitter impedances of these transistors have a greatly reduced effect.

Transistor 415 provides the reduced current to transistor 417 and transistor 419, and transistor 417 cooperates with transistor 421 to provide a current to transistors 423 and 425. Since transistor 421 may also provide a larger current by the use of a larger transistor, and the loading due to base current for transistor 421 is also made larger thereby, this additional loading is optionally compensated for by transistor 419, which is not otherwise required by the circuit.

Transistors 423 and 425 receive the current from transistor 421 discussed previously, and cooperatively produce a current from transistor 427. As before, transistor 425, like transistor 419, avoids loading effects, since transistor 427 may also provide a multiplied current, as discussed for transistor 421.

Transistor 427 then provides a current to transistor 429 which is proportional to the current provided by transistor 409, though possibly multiplied as discussed above. Transistor 429 receives the current from transistor 427 in the base connection, so the output current Io at the collector of transistor 429 is thereby beta multiplied. Since the betas of transistor 409 and transistor 429 are nominally matched, the result is as though no reduction and restoration had occurred, except that, as mentioned, the effects of impedances in the emitters of the intermediate transistors, that is, transistors 413, 415, 417, 421, 423 and 427, are greatly reduced, and more importantly, an impedance in the emitter of transistor 429 does not need to be matched with an impedance in the emitter of transistor 409. It can be expected that a difference in beta between transistor 409 and transistor 429 may create a small difference in the desired current, but this has proven to be less of a concern than the effects of different emitter impedances in the input and output transistors, specifically transistor 409 and transistor 429, mentioned above, when the invention is not used. The net result is an improvement in the characteristics of the bias circuit since an impedance in the emitter of transistor 429 does not reflect back on the matching transistor 409. Further, a reduction in parasitic heating due to the higher currents of the prior art, and a reduction in the voltage mismatches at the emitters thereby, may also be a benefit of this invention.

The foregoing descriptions of specific embodiments of the present invention have been presented for purposes of illustration and description. They are not intended to be exhaustive or to limit the invention to the precise forms disclosed, and it should be understood that many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A bias circuit comprising:

an input transistor having a collector receiving an input current, a emitter connected to ground, having an input base;

a current divider stage having gain and an output, receiving the output of the input stage, generating an intermediate current that corresponds to the input current divided by the magnitude of the gain, that includes, a first transistor having an emitter connected to the input base, a first collector, and a first base receiving the input current, and a second transistor having a collector and base connected to the first collector, and an emitter receiving power;

a current mirror having gain and an output, receiving the intermediate current, that includes, a third transistor having a base connected to the first collector, an emitter receiving receiving power, and a third collector; and an output transistor having a gain, having a base directly connected to the third collector, an emitter connected to a reference voltage, generating an output current proportional to the magnitude of the intermediate current;

wherein the emitter impedances of the divider stage and current mirror are different.

2. The bias circuit, as defined in claim 1, wherein the outputs of the divider stage and the current mirror have different voltages.

3. The bias circuit, as defined in claim 2, wherein the gains of the divider stage and current mirror are comparable in magnitude.

4. The bias circuit, as defined in claim 2, wherein the gain of the current mirror is substantially similar to the gain of the output transistor.

5. The bias circuit, as defined in claim 1, further comprising:

a voltage to current converter, connected to the collector of the input transistor, operative to convert a voltage to the input current.

6. The bias circuit, as defined in claim 1, further comprising:

a gain multiplying circuit receiving the output current, having an output;

a multiplying current mirror receiving the output of the gain multiplying circuit, having an output;

a reference current generating circuit receiving the output of the multiplying current mirror, having an output; and a level translating circuit receiving the output of the reference current generating circuit, generating an output current.

* * * * *